US010676249B2

(12) United States Patent
Powell et al.

(10) Patent No.: US 10,676,249 B2
(45) Date of Patent: Jun. 9, 2020

(54) PAPER LID FOR A CONTAINER

(71) Applicant: Huhtamäki Oyj, Espoo (FI)

(72) Inventors: Matt Powell, Portchester (GB); Christina Robinson-Meech, Portsmouth (GB); Peter Coote, Waterlooville (GB)

(73) Assignee: HUHTAMÄKI OYJ, Espoo (FI)

( * ) Notice: Subject to any disclaimer, the term of this patent is extended or adjusted under 35 U.S.C. 154(b) by 0 days.

(21) Appl. No.: 15/959,226

(22) Filed: Apr. 21, 2018

(65) Prior Publication Data

US 2018/0305090 A1 Oct. 25, 2018

(30) Foreign Application Priority Data

Apr. 21, 2017 (EP) ..... 17167604
Apr. 13, 2018 (EP) ..... 18167220

(51) Int. Cl.
*B65D 43/02* (2006.01)
*A47G 19/22* (2006.01)

(52) U.S. Cl.
CPC ..... *B65D 43/0212* (2013.01); *A47G 19/2272* (2013.01); *B65D 43/021* (2013.01); *B65D 2543/0024* (2013.01); *B65D 2543/00027* (2013.01); *B65D 2543/00046* (2013.01); *B65D 2543/0049* (2013.01); *B65D 2543/0075* (2013.01); *B65D 2543/00092* (2013.01); *B65D 2543/00268* (2013.01); *B65D 2543/00314* (2013.01); *B65D 2543/00537* (2013.01); *B65D 2543/00638* (2013.01); *B65D 2543/00685* (2013.01); *B65D 2543/00796* (2013.01)

(58) Field of Classification Search
CPC ..... B65D 43/021; B65D 43/0212; B65D 43/0204; B65D 2543/00268
USPC ..... 229/404, 903.1
See application file for complete search history.

(56) References Cited

U.S. PATENT DOCUMENTS

| | | | | |
|---|---|---|---|---|
| 1,422,018 A | | 7/1922 | Wright | |
| 1,706,007 A | * | 3/1929 | Van Alstyne | B65D 43/021 229/404 |
| 2,181,545 A | | 11/1939 | Boothby et al. | |
| 2,306,973 A | | 12/1942 | Mysels | |
| 3,420,397 A | * | 1/1969 | Miller | B65D 21/0233 206/519 |
| 5,339,977 A | | 8/1994 | Schormair et al. | |
| 5,385,255 A | * | 1/1995 | Varano | B65D 43/0212 220/380 |

(Continued)

FOREIGN PATENT DOCUMENTS

| | | |
|---|---|---|
| EP | 0639509 A1 | 2/1995 |
| EP | 2669212 A1 | 12/2013 |
| EP | 2674369 A1 | 12/2013 |

(Continued)

*Primary Examiner* — Nathan J Newhouse
*Assistant Examiner* — Phillip D Schmidt
(74) *Attorney, Agent, or Firm* — Husch Blackwell LLP

(57) ABSTRACT

The invention relates to a lid for closing a container, preferably a cup, the lid being made from a paper- or a cardboard-material, wherein the lid comprises a topwall which covers the opening of the container and a sidewall directed at an angle relative to the topwall, wherein one end of the sidewall can engage sealingly with the top end of the container. The present invention further relates to a set comprising a lid and a container.

14 Claims, 9 Drawing Sheets

(56) References Cited

U.S. PATENT DOCUMENTS

| | | | | |
|---|---|---|---|---|
| 2014/0144923 | A1 | 5/2014 | Panek et al. | |
| 2015/0090776 | A1 * | 4/2015 | Hyder ..... | B65D 43/0208 229/404 |

FOREIGN PATENT DOCUMENTS

| | | | |
|---|---|---|---|
| EP | 2674370 | A1 | 12/2013 |
| EP | 3000745 | A1 | 3/2016 |
| FR | 895860 | | 2/1945 |
| GB | 742814 | | 1/1956 |
| WO | 2014031880 | A1 | 2/2014 |

* cited by examiner

PAPER LID FOR A CONTAINER

CROSS-REFERENCE TO RELATED APPLICATIONS

This Application claims priority to European Patent Application No. 17167604.2, filed on Apr. 21, 2017, and European Patent Application No. 18167220.5, filed on Apr. 13, 2018, to Matt Powell et al., both of which are currently pending, the entire disclosures of which are incorporated herein by reference.

FIELD OF THE INVENTION

The invention relates to a lid for closing a container, preferably a cup, the lid being made from a paper- or a cardboard-material, wherein the lid comprises a topwall which covers the opening of the container and a sidewall directed at an angle relative to the topwall, wherein one end of the sidewall can engage sealingly with the top end of the container. Another aspect of the present invention relates to the combination of a lid and a container.

BACKGROUND OF THE INVENTION

Various lids to close a cup are known, for example from EP 2669212 A1, EP 3000745 A1, EP 2674369 A1, EP 2674370 A1, EP 0639509 A1, WO 14031880 and EP 2888178 A1. However, these lids are made from a plastic material or do not fit properly onto a container.

SUMMARY OF THE INVENTION

One objective of the present invention is to provide a lid, which can be recycled easily and which is easily attached to a container. It is also an objective of the present invention to provide a set with a lid and a cup that can be manufactured and recycled easily.

One embodiment of the present invention is directed to a lid for closing a container, preferably a cup, the lid being made from a paper- or a cardboard-material, wherein the lid comprises a topwall which covers the opening of the container and a sidewall directed at an angle relative to the topwall, wherein one end of the sidewall can engage sealingly with the top end of the container and wherein a rolled edge is provided at this end of the sidewall.

The present invention relates to a lid for a container, and particularly may relate to a lid for a cup for hot or cold beverages and/or food. The lid can be made from a paper or a cardboard-material. The lid is 3D-shaped and comprises a topwall which generally covers the opening of the container. Furthermore, the lid comprises a sidewall, which extends around the circumference of the topwall. The sidewall is directed at an angle relative to the topwall and engages the inner or the outer circumference of the top end of the container; i.e., the inside or the outside of the sidewall of the container. The lid can have a circular shape. The topwall and the sidewall can be made from two different blanks, which are formed and then connected, preferably glued together. The topwall and one end of the sidewall may be connected to each other along a rim, preferably a ring-shaped rim. The other, opposite end of the sidewall can be ring shaped and engages sealingly with the top end of the container. According to one embodiment of the present invention, a rolled edge is provided at this end; i.e., the edge of this sidewall is rolled. The rolling can comprise at least a segment of an arc, preferably >180°, more preferably >270° and even more preferably >360° or >450°.

The topwall and the sidewall made from the same material. According to one embodiment of the present invention, the lid is shaped like a cup with a small volume.

The rolled edge may extend inwardly or outwardly from the circumference of the sidewall of the lid. The edge may be rolled clockwise or counter-clockwise.

The sidewall of the lid may be cone-shaped or cylindrical.

According to one embodiment of the present invention, a shoulder is provided in the sidewall. The shoulder can extend from the outside of the circumference of the sidewall of the lid and may be provided between the rolled edge and the opposite end of the sidewall of the lid, which is preferably part of the rim. The shoulder can be shaped into the sidewall by compressing the sidewall of the lid in its height. The shoulder may extend around the entire circumference of the sidewall of the lid. The shoulder can be utilized as a de-stacking device and/or to delimit the movement of the lid relative to a cup, so that the lid cannot be pushed too far onto the cup.

At least one of the surfaces, and in some cases both surfaces or all surfaces of the lid, that come into contact with a liquid, for example contained in the container or vapor in the container, may be coated with a liquid repellent agent, for example a wax or a plastic film. Additionally or alternatively, the material, particularly the material from which the topwall of the lid is made, comprises a wet strength agent, particularly to avoid that the material is weakened at the circumference of an opening.

A rim can be provided at the top of the lid, which extends above the topwall of the lid. At this rim, the topwall and the sidewall can be connected. The rim can facilitate the consumption of a liquid provided in the container, by taking the rim into the mouth, the rim then guides the liquid towards and/or into the mouth of the consumer. The rim also can improve the stiffness of the lid and/or serve as a bearing for the lid, in case the lid is used as a cup or the like.

The topwall may comprise an opening, a sip hole, via which a liquid in a container can be consumed without removing the lid from the container. The opening can be provided by a scoring the material from which the topwall is made. By scoring, the topwall stays intact and is watertight, before the opening is opened. In one embodiment, only a segment of the circumference of the opening is scored, so that the cover of the opening remains at the topwall even after the opening is opened. The opening is provided remote from the rim that delimits the outer circumference of the topwall. In one embodiment, the opening has at least essentially the shape of a triangular, wherein one side of the triangular is curved and/or the edges of the triangular are round.

In one aspect of the present invention, a set comprising a lid according to any one of the preceding claims and a container may be provided, wherein the container comprises a rolled edge and/or a bulge, which engages with the rolled edge of the lid.

This subject matter also relates to a set comprising a cup and the inventive lid. Both the lid and the cup may be made from the same paper- and/or cardboard-material, so that they can be recycled together, without separation. The cup can comprise a sidewall and a bottomwall, which can be made from two separate blanks which are formed and then connected to each other, for example by means of a rim, which is may be the bearing for the cup. The sidewall of cup may be cylindrical but is preferably conical. The bottomwall and the sidewall of the cup may be made from the same material.

At its top end, the end opposite of the bottomwall, the cup is open, so that a liquid in the container can be poured. According to one embodiment of the present invention, a rolled edge is provided at this end; i.e., the edge of this sidewall is rolled. The rolling can comprise at least a segment of an arc, preferably >180°, more preferably >270° and even more preferably >360° or >450°.

The rolled edge may extend inwardly or outwardly from the circumference of the sidewall of the container. The edge may be rolled clockwise or counter-clockwise.

The rolled edge of the container and the rolled edge of the lid are preferably in contact with each other, in case the lid closes the container. This contact can be utilized as a seal and/or as a and/or force-fit to fasten the lid on the container. An outwardly extending rolled edge at the lid can cooperate with an inwardly extending rolled edge of the container and vice versa.

According to one embodiment of the present invention, the rolled edge of the container is in contact with the sidewall of the lid and/or with the shoulder at the sidewall of the lid to secure the position of the lid relative to the container and/or to provide a sealing.

In instances where the sidewall comprises a shoulder, the rolled edge of the container can be provided between the shoulder and the rolled edge of the lid in the closed state of the set. This embodiment may be particularly preferred, in a case where the edge of the sidewall of the container is rolled inwardly and the rolled edge and the shoulder of the sidewall of the lid extend outwardly.

Additionally or alternatively, the cup comprises a bulge at its top end, for example slightly below the rolled rim of the sidewall of the cup. The bulge is may be a formed, folded or deep drawn part of the sidewall. In a case where the sidewall comprises two layers, the bulge is preferably formed into the inner layer. The bulge may extend preferably from the sidewall towards the inner volume of the cup. The bulge can extend around the entire inner circumference of the sidewall. The bulge and the rolled edge at the lid are in contact with each other, when the container is closed by the lid.

Other and further objects of the invention, together with the features of novelty appurtenant thereto, will appear in the course of the following description.

DESCRIPTION OF THE SEVERAL VIEWS OF THE DRAWING

The inventions are now explained in the following section with reference to two exemplary embodiments. These explanations do not limit the scope of protection. The explanations apply to both inventions, respectively.

DETAILED DESCRIPTION OF THE INVENTION

Figure 1:
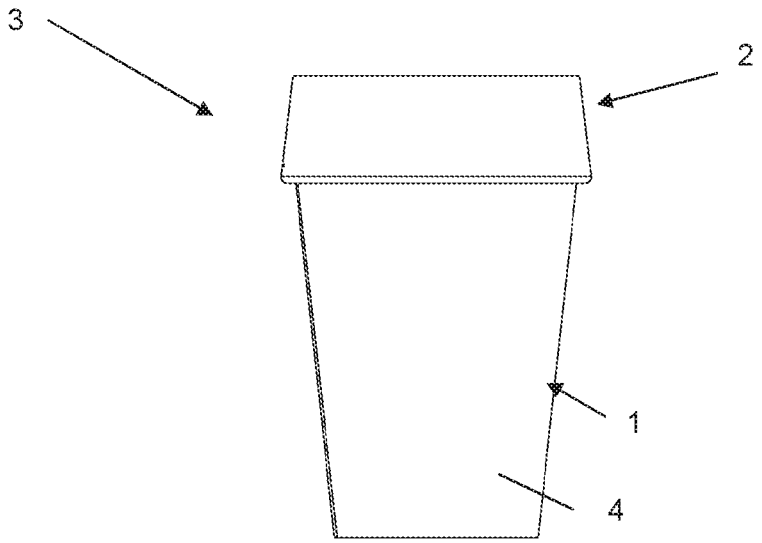
FIG. 1 is a side view of a lid attached to a container in accordance with a first embodiment of the present invention.
Figure 2:
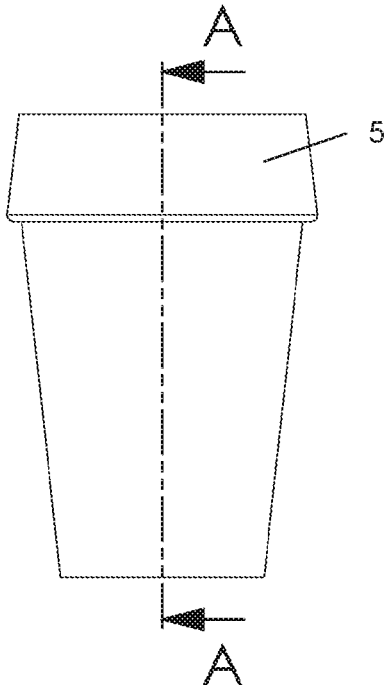
FIG. 2 is another side view of the lid and container of FIG. 1 further illustrating section line A-A.
Figure 3:
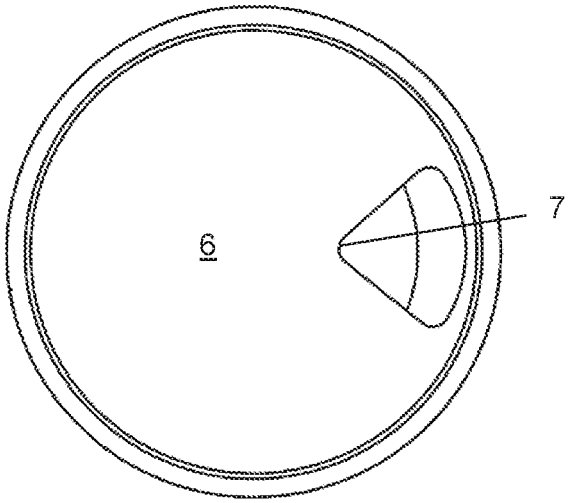
FIG. 3 is a top view of the lid and container of FIG. 1.
Figure 4:
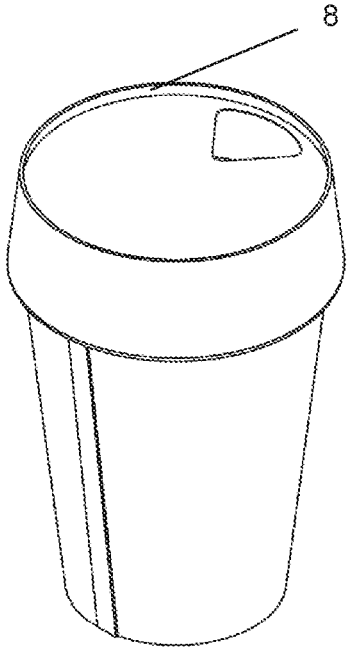
FIG. 4 is a top perspective view of the lid and container of FIG. 1.

The invention will now be described with reference to the drawing figures, in which like reference numerals refer to like parts throughout. For purposes of clarity in illustrating the characteristics of the present invention, proportional relationships of the elements have not necessarily been maintained in the drawing figures. It will be appreciated that any dimensions included in the drawing figures are simply provided as examples and dimensions other than those provided therein are also within the scope of the invention.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIGS. 1-8B show a first embodiment of the inventive lid 2 and the inventive set. As shown, the lid 2 comprises a sidewall 5 and a topwall 6, both of which may be made from a paper- and/or cardboard-material. This material can be coated with a water- and/or moisture repellent agent at one or both of its surfaces. The sidewall 5 and the topwall 6 can be made from separate blanks, which are formed and connected, for example at a rim 8. In the present case, the sidewall 5 is shaped conically. At the end of the sidewall 5 that is opposite from the end at which the topwall 6 is provided, the sidewall 5 is rolled, so that a rolled edge 10 is provided. In the present case, the sidewall 5 is rolled inwardly; i.e., the rolled edge 10 extends from the inner circumference of the sidewall 5. The sidewall 5 and the topwall 6 can be made from the same material. In the topwall, an opening 7, a sip hole may be provided, via which a liquid contained in the container 1 can be consumed without removing the lid 2 from the container 1. This opening 7 can be prefabricated by a scored line, which may extend only partially around the circumference of the opening. The opening 7 can be provided by pushing or drawing the section within the score away from the topwall 6. As can be seen for example from FIG. 3, the opening 7 is remote from the rim 8 of the lid 2.

The container 1 comprises a sidewall 4 and a bottomwall 14, which can be made from two separate blanks, which are formed and then connected at a rim 15. The rim 15 can serve as bearing for the container 1. At the end opposite from the bottom, the sidewall 4 may be rolled; i.e., a rolled edge 9 can be provided. In the present case, the rolled edge 9 extends outwardly from the outer circumference of the sidewall 4. The sidewall 4 and the bottomwall 14 of the container 1 can be made from the same material, such as a paper- and/or a cardboard-material. More preferably, the material of the container and the material of the lid are the same.

Figure 5:
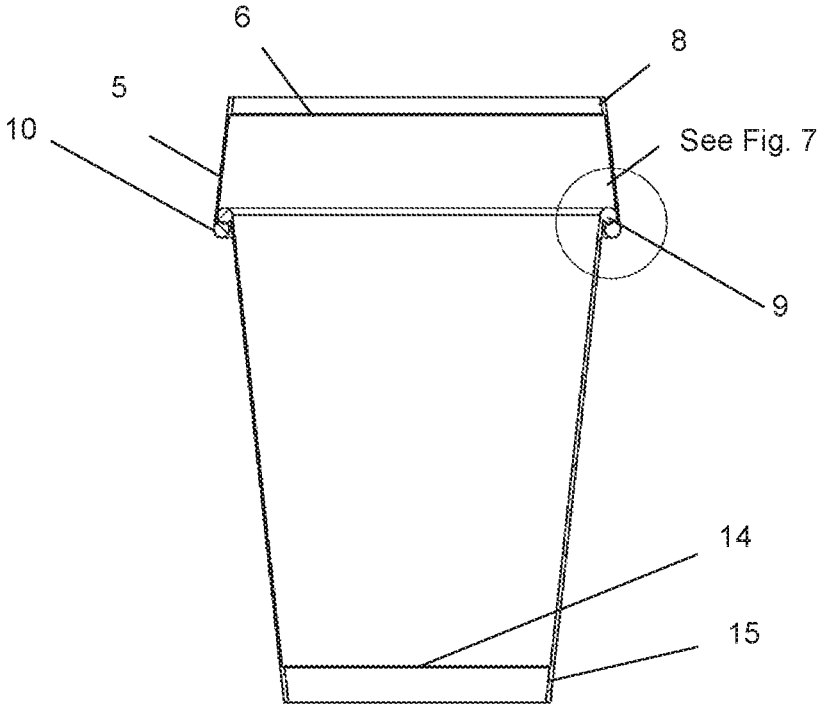
FIG. 5 is a sectional side view of the lid and container of FIG. 1 taken generally about line A-A (see FIG. 2) in the direction of the arrows.
Figure 6A:
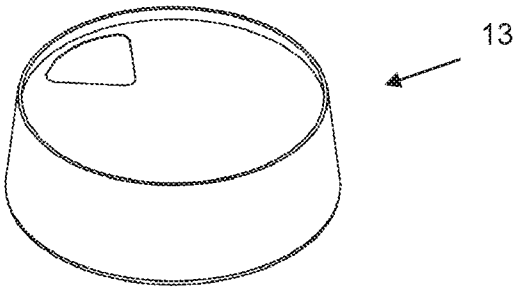
FIG. 6A is a top perspective view of the lid of FIG. 1.
Figure 6B:
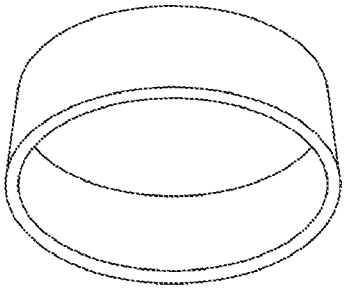
FIG. 6B is a bottom perspective view of the lid of FIG. 1.
Figure 7:
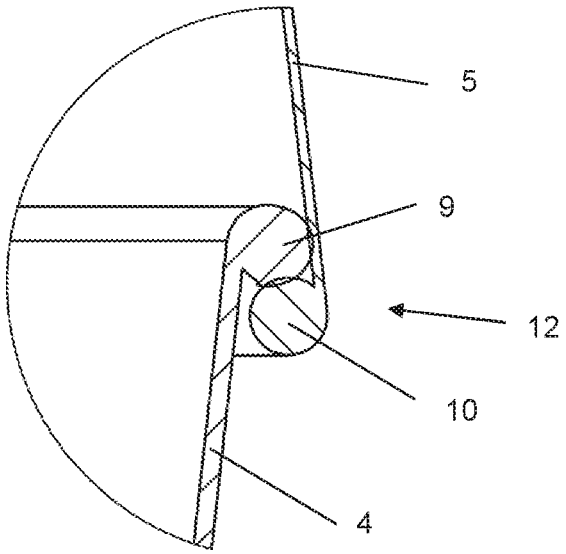
FIG. 7 is an enlarged partial sectional side view of the lid and container of FIG. 5.
Figure 8A:
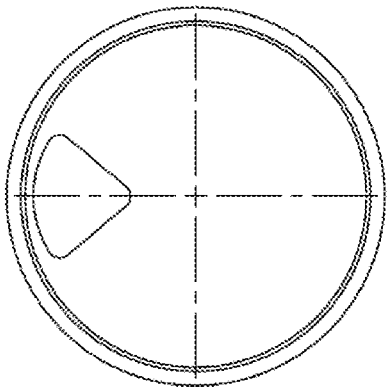
FIG. 8A is a top view of the lid of FIG. 1.
Figure 8B:
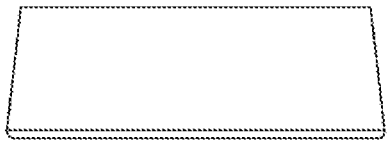
FIG. 8B is a side view of the lid of FIG. 1.
Figure 9:
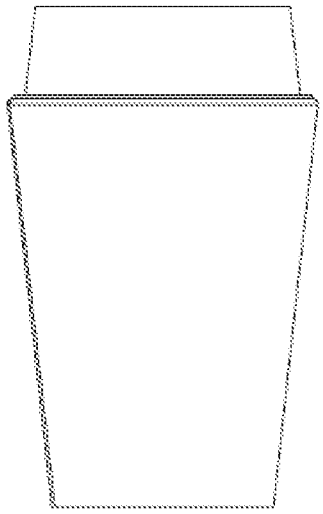
FIG. 9 is a side view of a lid attached to a container in accordance with a second embodiment of the present invention.
Figure 10:
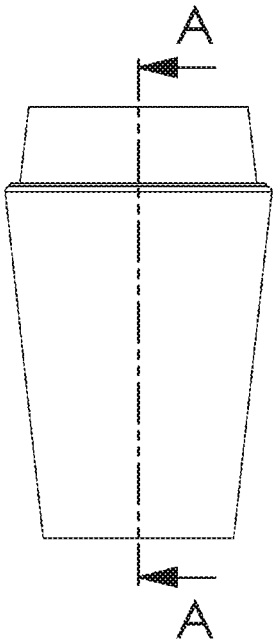
FIG. 10 is another side view of the lid and container of FIG. 9 further illustrating section line A-A.
Figure 11:
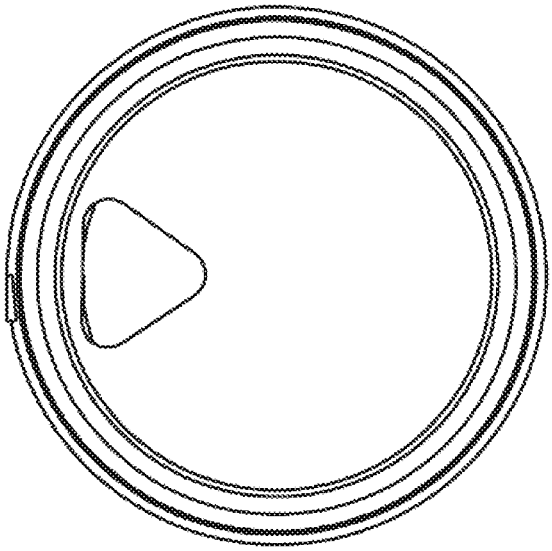
FIG. 11 is a top view of the lid and container of FIG. 9.
Figure 12:
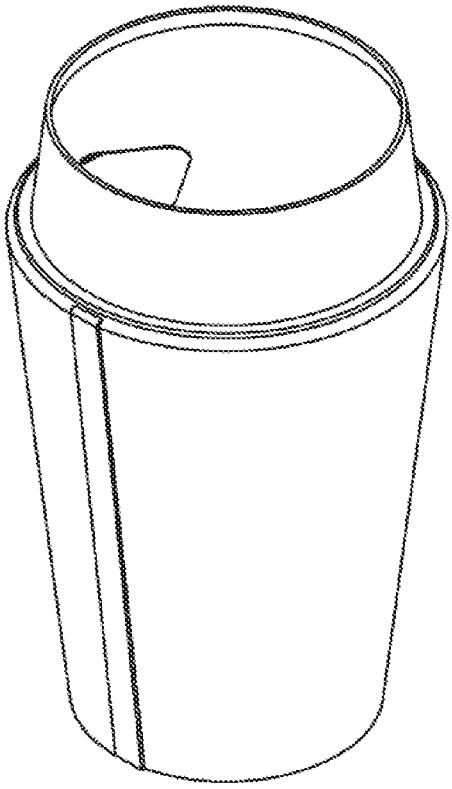
FIG. 12 is a top perspective view of the lid and container of FIG. 9.
Figure 13:
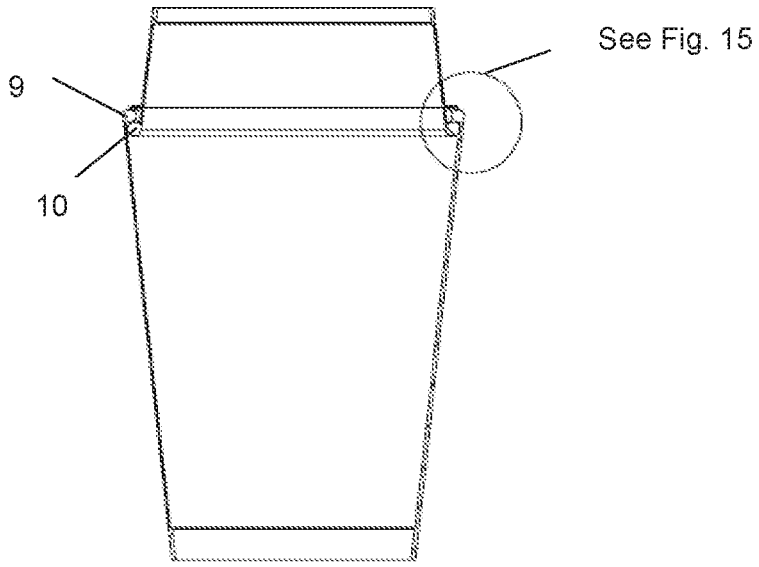
FIG. 13 is a sectional side view of the lid and container of FIG. 9 taken generally about line A-A (see FIG. 2) in the direction of the arrows.
Figure 14A:
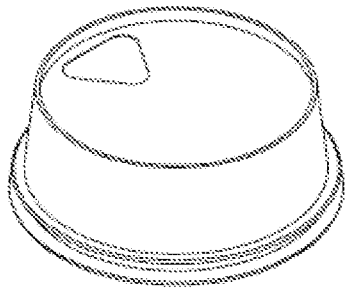
FIG. 14A is a top perspective view of the lid of FIG. 9.
Figure 14B:
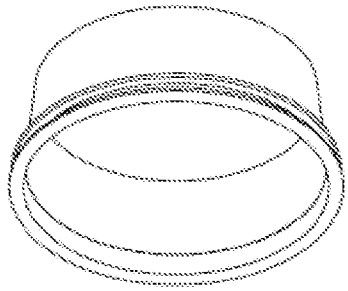
FIG. 14B is a bottom perspective view of the lid of FIG. 9.
Figure 15:
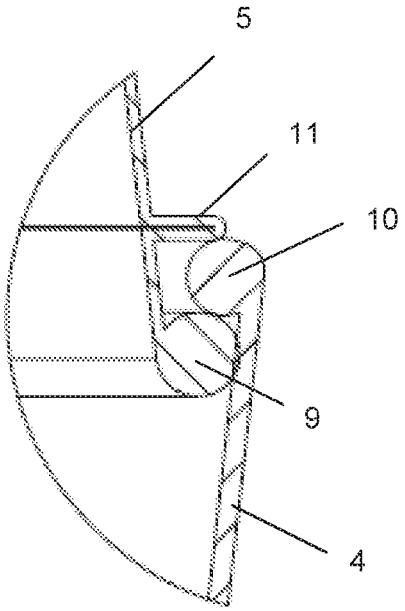
FIG. 15 is an enlarged partial sectional side view of the lid and container of FIG. 13.
Figure 16A:
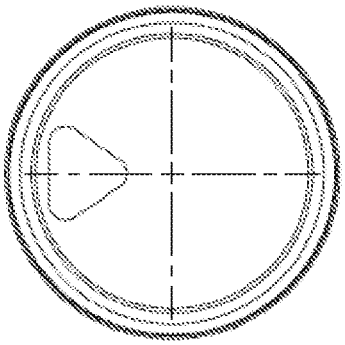
FIG. 16A is a top view of the lid of FIG. 9.
Figure 16B:
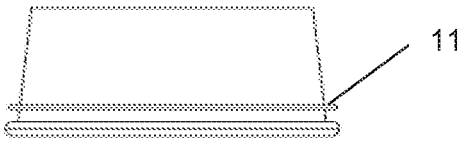
FIG. 16B is a side view of the lid of FIG. 9.

In FIGS. 5 and 7, the lid 2 is shown on top of the container 1. It can be clearly seen, that the inwardly rolled edge 10 is in contact with the outwardly rolled edge 9 of the sidewall 4 of the container 1, so that the lid 2 is fixed at the container 1 and/or that a seal is provided. The sidewall of lid may also in contact with the rolled edge 9 of the container to provide a seal and/or to delimit the downward movement of lid relative to the container. This delimitation may be supported by the cone-shape of the sidewall 5 of the lid 2. The inner circumference of the rolled edge 10 and the outer circumference of the rolled edge 9 may be designed such, that a compression of the rolled edge 9 and/or an extension of the rolled edge 10 may take place during the provision of the lid 2 on the container 1, so that a snap-fit takes place when the rolled edge 10 has passed the rolled edge 9.

A person skilled in the art may recognize that the lid 2 and the container 1 can have essentially the same shape and only differ in size. The lid 2 can also be utilized as a container 1, for example a cup, when the lid stands on the rim 8.

FIGS. 9-16B show a second embodiment of the inventive lid 2 and the inventive set 3.

Essentially reference can be made to the disclosure regarding the first embodiment. However, in the present case, the rolled edge 10 at the lid extends from the outer surface of the sidewall 5 of the lid 2, while the rolled edge 9 extends from the inner surface of the sidewall 4 of the container 1. Additionally, the sidewall 5 of the lid 2 comprises a shoulder 11, which here extends from the outer circumference of the sidewall 5 of the lid 2. In the closed state, the rolled edge 9 of the sidewall 4 of the container 1 is provided between the shoulder 11 and the rolled edge 10 of the sidewall 5 of the lid 2. This configuration secures the lid 2 at the container 1 and provides sealing between the container 1 and the lid 2.

Figure 17:
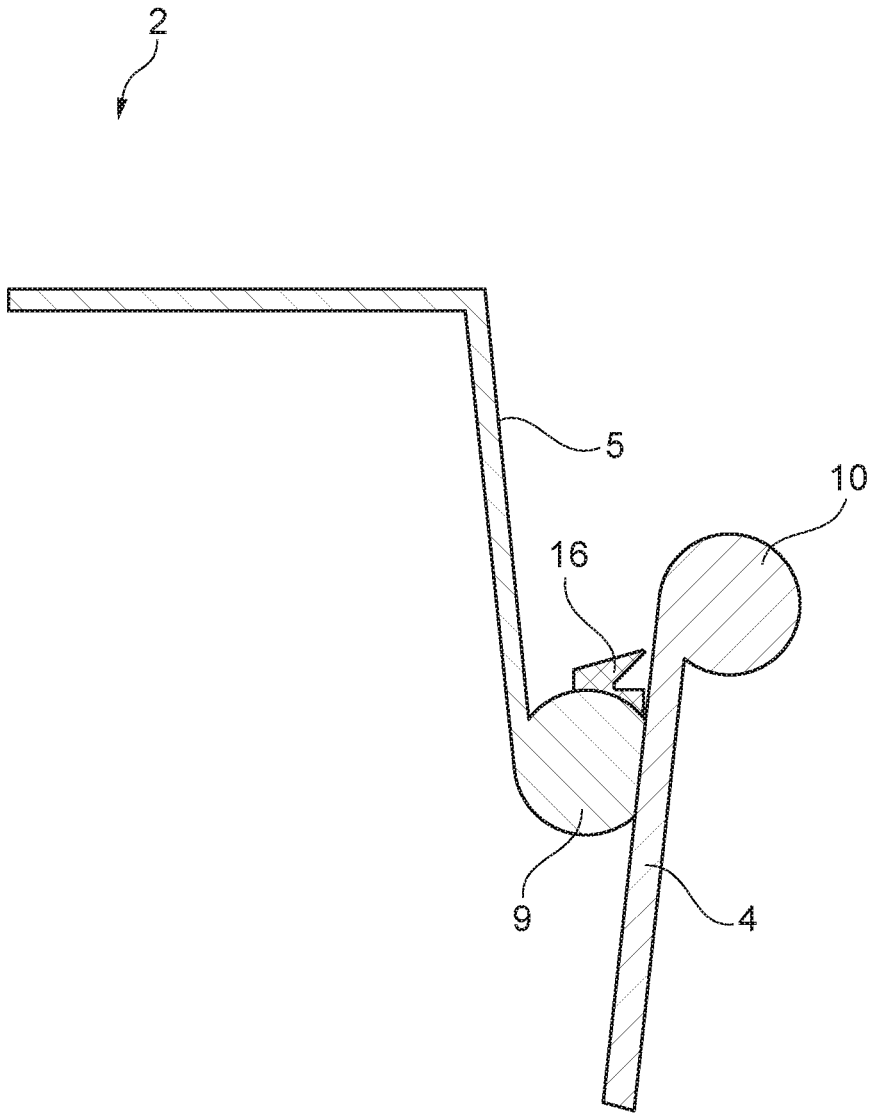
FIG. 17 is an enlarged partial sectional side view of a lid and a container illustrating a bulge extending from an inner circumference of the container in accordance with one embodiment of the present invention.

In FIG. 17 yet another embodiment of the invention is shown. In the present case, the sidewall 4 of the container 1 comprises a bulge 16, which can be formed into the sidewall 4. The bulge 16 extends out of the inner circumference of the container and may extend around the entire inner circumference of the container 1. In the closed state, the bulge 16 and the rolled rim 16 are in contact with each other in order to hold the lid 2 in place and/or to provide a seal. The rolled edge 9 of the rim is in the closed state of the set preferably also in contact with the inner circumference of the sidewall 4 of the container 1. During closing, the bulge 16 may be elastically deformed by the rolled edge 9 of the lid 2. However, as soon as this rolled edge 9 of the lid 2 has passed the bulge 16, the bulge 16 forms itself back towards its original shape. The same may happen during removal of the lid 2 from the container 1.

The inventive set may have the advantage, that it can be recycled without separating the lid 2 from the container 1. The inventive lid 2 can be produced easily. The shoulder 11 can additionally be utilized as a de-stacking device.

From the foregoing, it will be seen that this invention is one well adapted to attain all the ends and objects hereinabove set forth together with other advantages which are inherent to the structure and method. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. Set comprising:

a lid being made from a paper- or a cardboard-material, the lid comprising:

a topwall for covering an opening of a container;

a sidewall directed at an angle relative to the topwall;

a shoulder provided in the sidewall of the lid; and a rolled edge provided at an end of the sidewall;

wherein the end of the sidewall can engage sealingly with the top end of the container;

wherein the shoulder extends from the outside of a circumference of the sidewall of the lid; and a container comprising:

at least one of a rolled edge and a bulge;

wherein the at least one of a rolled edge and a bulge engages with the rolled edge of the lid;

wherein the at least one of a rolled edge and a bulge is in contact with the shoulder provided in the sidewall of the lid to secure the position of the lid relative to the container and/or to provide a sealing engagement with the lid.

2. Set according to claim 1, wherein the sidewall of the lid is cone-shaped.

3. Set according to claim 1, wherein the sidewall of the lid is cylindrical.

4. Set according to claim 1, wherein the shoulder in the sidewall of the lid is shaped into the sidewall of the lid by compressing the sidewall of the lid in its height.

5. Set according to claim 1, wherein at least one surface of the lid is coated with liquid repellent agent.

6. Set according to claim 1, wherein the lid further comprises a rim.

7. Set according to claim 1, wherein the topwall comprises an opening.

8. Set comprising:

a lid being made from a paper- or a cardboard-material, the lid comprising:

a topwall for covering an opening of a container;

a sidewall directed at an angle relative to the topwall;

a shoulder provided in the sidewall of the lid; and a rolled edge provided at an end of the sidewall;

wherein the end of the sidewall can engage sealingly with the top end of the container;

wherein the shoulder is shaped into the sidewall of the lid by compressing the sidewall of the lid in its height; and a container comprising:

at least one of a rolled edge and a bulge;

wherein the at least one of a rolled edge and a bulge engages with the rolled edge of the lid;

wherein the at least one of a rolled edge and a bulge is in contact with the shoulder provided in the sidewall of the lid to secure the position of the lid relative to the container and/or to provide a sealing engagement with the lid.

9. Set according to claim 8, wherein the rolled edge of the lid extends outwardly from the sidewall of the container.

10. Set according to claim 8, wherein the sidewall of the lid is cone-shaped.

11. Set according to claim 8 wherein the sidewall of the lid is cylindrical.

12. Set according to claim 8, wherein at least one surface of the lid is coated with liquid repellent agent.

13. Set according to claim 8, wherein the lid further comprises a rim.

14. Set according to claim 8, wherein the topwall comprises an opening.

* * * * *